US006701906B2

(12) United States Patent
Kim

(10) Patent No.: US 6,701,906 B2
(45) Date of Patent: Mar. 9, 2004

(54) SYSTEM AND METHOD FOR CONTROLLING FUEL INJECTION

(75) Inventor: Hyung-Kee Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/226,513

(22) Filed: Aug. 23, 2002

(65) Prior Publication Data

US 2003/0047172 A1 Mar. 13, 2003

(30) Foreign Application Priority Data

Aug. 31, 2001 (KR) ..... 2001-53520

(51) Int. Cl.[7] ..... F02D 41/00
(52) U.S. Cl. ..... 123/698; 123/520; 123/488
(58) Field of Search ..... 125/520, 698, 125/338, 488, 502, 179.16–179.18, 184.53, 196 CP, 571

(56) References Cited

U.S. PATENT DOCUMENTS 4,942,860 A * 7/1990 Chujo et al. ..... 123/406.44
5,083,543 A * 1/1992 Harada et al. ..... 123/492
6,035,640 A * 3/2000 Kolmanovsky et al. .... 60/605.2
6,491,032 B1 * 12/2002 Kanno ..... 123/680
6,513,510 B2 * 2/2003 Hyung-Kee ..... 123/696

* cited by examiner

*Primary Examiner*—Willis R. Wolfe
*Assistant Examiner*—Johnny H. Hoang
(74) *Attorney, Agent, or Firm*—Morgan Lewis & Bockius LLP

(57) ABSTRACT

A system and method for controlling fuel injection of a vehicle, in which a MAP (manifold absolute pressure) sensor is used to calculate variations in intake pressure in a purge interval to perform compensation of a final fuel amount, thereby improving drive performance and minimizing fuel consumption. The system and method perform compensation of the final fuel amount in the two cases (a) where the canister is at high loading and when changing from one of an idle state and a light load state to one of a part load and a full load state, and (b) where the canister is at low loading and when changing from one of the part load state and the full load state to one of the idle state and the light load state.

14 Claims, 3 Drawing Sheets

SYSTEM AND METHOD FOR CONTROLLING FUEL INJECTION

FIELD OF THE INVENTION

The present invention relates to a system and method for controlling fuel injection, and more particularly, to a system and method for controlling fuel injection, in which a MAP (manifold absolute pressure) sensor is used to calculate variations in intake pressure in a purge interval to control the amount of fuel that is injected.

BACKGROUND OF THE INVENTION

An ECU (electronic control unit) is typically provided in an engine to perform overall control of the engine. For example, the ECU receives various inputs such as vehicle speed, engine rpm, etc., and controls a fuel injector based on the received data.

Since the majority of air pollution caused by vehicles is a result not only of exhaust gases but of fuel vapors, measurements are taken in most vehicles to minimize the escape of fuel vapors into the atmosphere. In particular, hydrocarbons evaporated from the fuel tank are stored in a canister and then supplied at suitable times to the engine through a purge control solenoid valve (PCSV). Accordingly, the amount of fuel vapors released into the atmosphere is greatly reduced. For ease of explanation, evaporated hydrocarbons in the canister will be referred to as "purge fuel". Similarly, fuel injected from the canister will be referred to as fuel "purged" from the canister.

The amount of fuel purged to the engine through the PCSV directly influences engine operation, thereby controlling the amount of purge fuel supplied to the engine. If an excessive amount of fuel vapors or pure air is purged to the engine at idle speed, the air-fuel mixture becomes too rich or lean, respectively, which may result in stalling of the engine.

To remedy this problem, when the purge fuel is supplied to the engine, purge fuel feedback control is performed such that if the concentration of hydrocarbons in the purge fuel is high, a purge fuel feedback value is increased, and the amount of fuel injected into the engine through the fuel injector is decreased by the feedback value.

FIG. 3 shows a block diagram of a conventional system to control fuel injection. In the conventional system, an ECU 51 receives signals from a PCSV 53, an engine rpm sensor 55, a throttle position sensor 57, an oxygen sensor 59, and a coolant temperature sensor 61, and then controls a fuel injector 63 according to the received signals.

FIG. 4 shows a flow chart of a method for controlling fuel injection using the above system.

The ECU 51 receives a purge duty signal from the PCSV 53 to detect a purge interval in step S100. That is, a signal value greater than 0 when a coolant temperature is greater than or equal to a predetermined value, and basic fuel feedback conditions are not satisfied indicating that fuel is not being purged.

If conditions for a purge interval are satisfied in step S100, it is determined whether fuel feedback control is being performed in step S110. That is, fuel feedback control is performed if the oxygen sensor 59 is activated and the coolant temperature is greater than or equal to a predetermined value, and in fuel feedback control, feedback gains including an integral gain (I-gain) and a proportional gain (P-gain), are measured. The feedback gains establish an acceleration fuel injection quantity determined to be suitable during acceleration when there is a change from a throttle-off state (i.e., when a throttle valve is closed) to a throttle-on state (i.e., when the throttle valve is open), after which the fuel injection amount is supplied to the engine through the fuel injector 63. The feedback gains are also implemented during acceleration such that harmful elements in the exhaust gases are reduced.

If it is determined that fuel feedback control is being performed in step S110, the ECU 51 calculates a purge ratio Pr and a purge concentration Pc in step S120. The purge ratio Pr is a ratio of purge air to intake air (purge air/intake air), while the purge concentration Pc is a ratio of a purge fuel amount to a purge amount (purge fuel amount/purge amount). The following are equations for calculating the purge ratio Pr and the purge concentration Pc.

$$A/F = \frac{\text{(amount of intake air} \times \text{air density)} + \text{(amount of purge air} \times \text{air density)}}{\text{(base fuel amount} \times \text{liquid fuel density)} + \text{(purge fuel amount} \times \text{gaseous fuel density)}} \quad \text{[Equation 1]}$$

If feedback control is performed, an average A/F (air/fuel ratio) is maintained at the stoichiometric value 14.7. Equation 1 is used for Equation 2 below.

$$Pc = \frac{1 + Pr - (I - \text{gain} \times \text{purge fuel amount compensation value})}{Pr \times \left(1 + 14.7 \times \frac{\text{gaseous fuel density}}{\text{air density}}\right)} \quad \text{[Equation 2]}$$

Here, I-gain is assumed to be 1.0, the gaseous fuel density is assumed to be 3.21 g/l, and the air density is assumed to be 1.29 g/l. Consequently, Equation 2 becomes as follows:

$$Pc = \frac{1 + Pr - \text{purge fuel amount compensation value}}{37.6 \times Pr} \quad \text{[Equation 3]}$$

After the calculation of the purge ratio Pr and the purge concentration Pc in step S120, a purge fuel amount compensation value (% fuel_purge) is calculated using the purge ratio Pr and the purge concentration Pc values in step S130. The purge fuel amount compensation value (% fuel_purge) is calculated using Equation 4 below.

$$\%\ \text{fuel_purge} = 1 + Pr - 37.6 \times Pr \times Pc \quad \text{[Equation 4]}$$

Subsequently, a final fuel amount (% fuel_final) for supply to the fuel injector 63 is calculated in step S140. The final fuel amount (% fuel_final) is calculated using Equation 5 below.

$$\%\ \text{fuel_final} = \text{base fuel amount} \times (1 - \%\ \text{fuel_purge}) \quad \text{[Equation 5]}$$

However, with the control of fuel injection using the above method, in a high temperature state or in an idle state, for example, where a fuel of a high volatility is used and/or if the vehicle is left idling for long periods, a large amount of purge gas (mostly hydrocarbons) accumulates in the canister. If the vehicle is then driven in this state, a significant amount of purge gas is supplied to the engine through the PCSV. At this time, the purge fuel amount compensation value (% fuel_purge) increases such that the final fuel amount (% fuel_final) supplied through the fuel injector 63 decreases. This result is evident from Equation 5.

If the vehicle is driven from an idle state under such conditions, (a) a difference between an intake pressure during idle and an intake pressure in a part load state causes a difference in pressure variation values between opposing ends of the PCSV 53, (b) a calculated amount (a desired amount) of purge fuel is not supplied to the engine, and (c) the final fuel amount (% fuel_final) is decreased such that the engine air to fuel ratio (A/F) becomes lean and the driver experiences hesitation or a jerky forward motion.

Further, in a low temperature state or when a fuel of a low volatility is used, since there are almost no fuel vapors in the fuel tank, hydrocarbons do not accumulate in the canister. Accordingly, during the supply of purge gas to the engine, it is mostly air that is being supplied. If feedback is performed under such conditions, a negative value results for the purge fuel amount such that the final fuel amount (% fuel_final) increases. At this time, if the vehicle is operated in an idle state, a difference in pressure variation values between opposing ends of the PCSV 53 results, and the amount of purge fuel supplied to the engine is greater than that calculated (desired) such that a rich air to fuel ratio results, thereby causing the combustion of unneeded fuel.

SUMMARY OF THE INVENTION

The present invention provides a system and method for controlling fuel injection, in which a MAP (manifold absolute pressure) sensor is used to calculate variations in intake pressure in a purge interval to compensate a final fuel amount supplied to the engine, thereby improving drive performance and minimizing fuel consumption.

The present invention thus provides a method for controlling fuel injection, in which an ECU for controlling an engine calculates a base fuel amount, receives an output voltage from an oxygen sensor, and calculates a purge fuel amount compensation value and a final fuel amount using a feedback gain, a purge ratio, and a purge concentration, which are based on a difference between the output voltage and a standard voltage, after which the ECU controls a fuel amount that is supplied through a fuel injector. The method of the invention thus includes detecting a purge duty signal and determining if conditions for a purge interval of the engine are satisfied; determining if conditions for feedback control of the engine are satisfied; receiving intake pressure signals from a MAP sensor; calculating the purge ratio and the purge concentration; calculating the purge fuel amount compensation value using the purge ratio and the purge concentration; determining if the purge fuel amount compensation value is greater than a first critical rate; calculating a change in intake pressure if the purge fuel amount compensation value is greater than the first critical rate; determining if the change in intake pressure is greater than a first critical value; calculating a first final fuel amount compensation value if the change in intake pressure is greater than the first critical value, and controlling the final fuel amount using the first final fuel amount compensation value; determining if the purge fuel amount compensation value is less than a second critical rate if the purge fuel amount compensation value is not greater than the first critical rate; calculating the change in intake pressure if the purge fuel amount compensation value is less than the second critical rate; determining if the change in intake pressure is less than a second critical value; and calculating a second final fuel amount compensation value if the change in intake pressure is less than the second critical value, and controlling the final fuel amount using the second final fuel amount compensation value.

The change in intake pressure is preferably obtained by taking the absolute value of a difference between a present intake pressure and a previous intake pressure.

The first final fuel amount compensation value is obtained by subtracting a product of a compensation constant, the change in intake pressure, and the purge fuel amount compensation value from the integer 1, then multiplying the result by the base fuel amount.

The second final fuel amount compensation value is obtained by subtracting a product of a compensation constant, the change in intake pressure, and the purge fuel amount compensation value from the integer 1, then multiplying the result by the base amount.

The present invention also provides a system for controlling fuel injection comprising an ECU for controlling an engine including a fuel injector of the engine according to signals received from a purge control solenoid valve, an engine rpm sensor, a throttle valve position sensor, an oxygen sensor, and a MAP sensor for indirectly detecting an intake pressure from vacuum variations of an intake manifold and output voltage signals. The ECU, in a purge interval, calculates a base fuel amount and a purge fuel amount compensation value, and when changing from one of an idle state and a light load state to one of a part load and a full load state, applies a first final fuel amount compensation value to compensate a final fuel amount in the case where the purge fuel amount compensation value is excessively positively learned. The first final fuel amount compensation value is obtained by subtracting a product of a first compensation constant, a change in intake pressure, and the purge fuel amount compensation value from the integer 1, then multiplying the result by the base fuel amount. The ECU, when changing from one of the part load state and the full load state to one of the idle state and the light load state, applies a second final fuel amount compensation value to compensate the final fuel amount in the case where the purge fuel amount compensation value is determined to be excessively negative. The first final fuel amount compensation value is obtained by subtracting a product of a second compensation constant, a change in intake pressure, and the purge fuel amount compensation value from the integer 1, then multiplying the result by the base fuel amount.

According to a further alternative embodiment of the invention, the electronic control unit is programed to execute instructions for controlling an amount of fuel to a fuel injector based on parameters comprising at least a change in intake pressure as calculated by the ECU based on signals received from a MAP sensor. The control is preferably based on additional parameters, for example feedback gain, purge ratio, purge concentration and selected critical rates. In a further preferred embodiment, the ECU is programed to calculate a base fuel amount and a purge fuel amount compensation value by which the base fuel amount is multiplied to determine a final fuel amount. The purge fuel amount compensation value is preferably based at least in part on said change in intake pressure.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
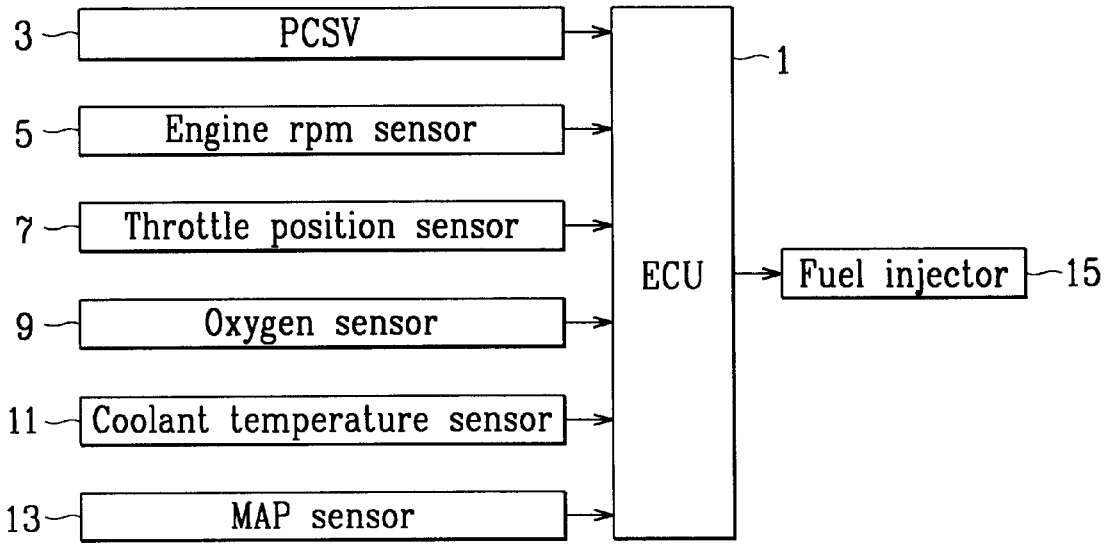
FIG. 1 is a block diagram of a system for controlling fuel injection and related elements according to a preferred embodiment of the present invention.

As shown in FIG. 1, a system for controlling fuel injection according to the present invention includes a PCSV (purge control solenoid valve) 3 for performing purge control of a canister according to the state of an engine; an engine rpm sensor 5 for detecting engine rpm; a throttle position sensor 7 for detecting an opening angle of a throttle valve; an oxygen sensor 9 for detecting an amount of oxygen in exhaust gases; a coolant temperature sensor 11 for detecting a temperature of coolant; and a MAP (manifold absolute pressure) sensor 13 for indirectly detecting an intake pressure according to vacuum variations of an intake manifold. A fuel injector 15 supplies fuel to the engine and an ECU 1 operates the fuel injector 15 to control the amount of fuel injected into the engine. The control of the fuel injector 15 is performed according to signals received from the above elements.

Figure 2:
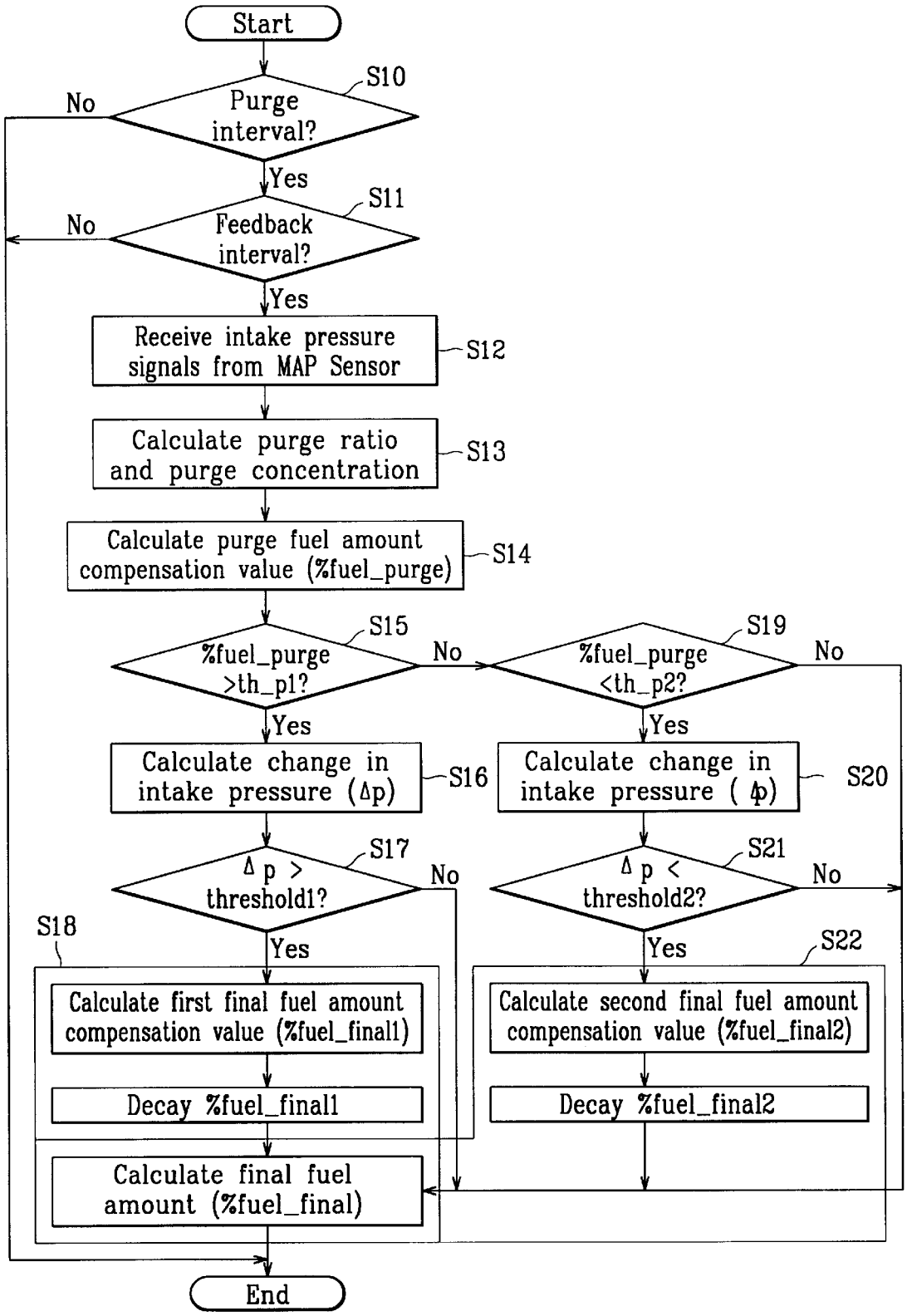
FIG. 2 is a flow chart of a method for controlling fuel injection according to a preferred embodiment of the present invention.
Figure 3:
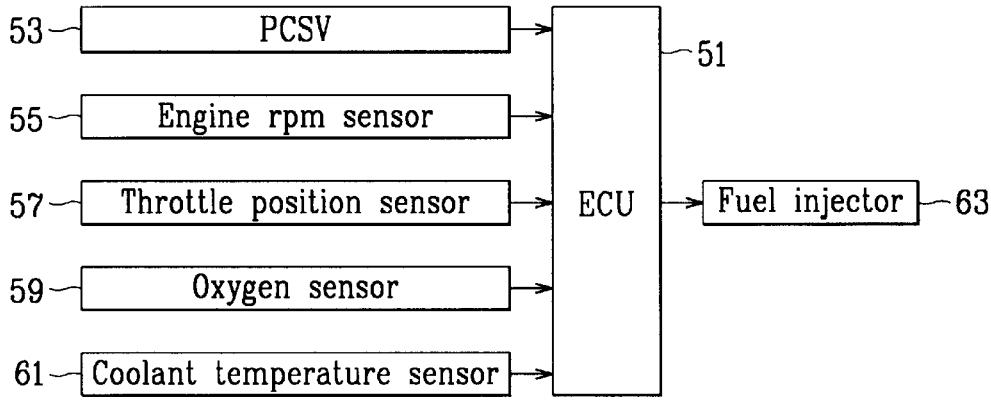
FIG.3(Prior Art)
FIG. 3 is a block diagram of a conventional system for controlling fuel injection.
Figure 4:
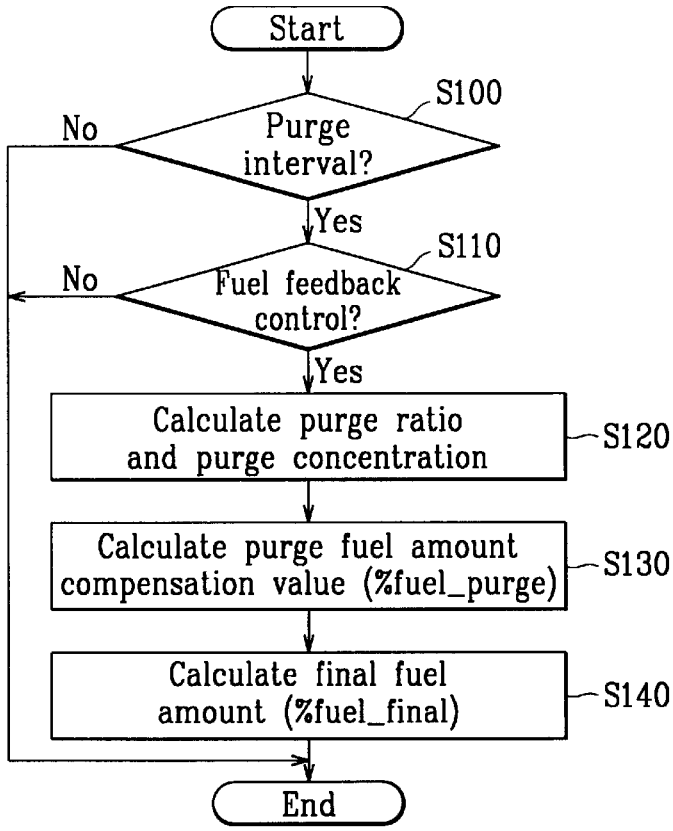
FIG.4(Prior Art)
FIG. 4 is a flow chart of a conventional method for controlling fuel injection.

Operation of the system according to an embodiment of the invention is described with reference to FIG. 2. The ECU 1 detects a purge signal to determine if fuel is being purged to the engine (i.e., if the engine is in a purge interval) in step S10. Preferably, it is determined that the engine is in a purge interval if a purge duty value is greater than 0 in the case where a coolant temperature is greater than or equal to a predetermined level and when base fuel amount analysis conditions are not satisfied.

If the engine is not in a purge interval, the process of controlling fuel injection is discontinued. However, if it is determined that the engine is in a purge interval, it is determined if fuel feedback control is being performed in step S11. Fuel feedback control is performed if the oxygen sensor 9 is activated and the coolant temperature received from the coolant sensor 11 is greater than or equal to a predetermined value #. In fuel feedback control, feedback gains including an integral gain (I-gain) and a proportional gain (P-gain) are measured. The feedback gains establish an acceleration fuel injection quantity determined to be suitable during acceleration when there is a change from a throttle-off state (i.e., when a throttle valve is closed) to a throttle-on state (i.e., when the throttle valve is open), after which the fuel injection amount is supplied to the engine through the fuel injector 15.

If it is determined that feedback control is not being performed in step S11, the process of controlling fuel injection is discontinued. However, if fuel feedback control is being performed, the ECU 1 receives intake pressure signals of an intake manifold from the MAP sensor 13 in step S12. Subsequently, the ECU 1 calculates a purge ratio Pr and a purge concentration Pc in step S13. The purge ratio Pr is a ratio of purge air to intake air, while the purge concentration Pc is a ratio of a purge fuel amount to a purge amount. The equations used to determine the purge ratio Pr and the purge concentration Pc are identical to equations used in conventional methods as described above.

After the calculation of the purge ratio Pr and the purge concentration Pc in step S13, a purge fuel amount compensation value (% fuel_purge) is calculated using the purge ratio Pr and the purge concentration Pc values in step S14. The equation used to determine the purge fuel amount compensation value (% fuel_purge) is also identical to the equation used in conventional methods as described above.

Next, it is determined if the purge fuel amount compensation value (% fuel_purge) is greater than a first critical rate (th_p1) in step S15. For example, the first critical rate (th_p1) may be set at +20%. A purge fuel amount compensation value (% fuel_purge) greater than the first critical rate (th_p1) is indicative of a high concentration of hydrocarbons in the canister.

If it is determined that the purge fuel amount compensation value (% fuel_purge) exceeds the first critical rate (th_p1) in step S15, an intake pressure is measured using the MAP sensor 13 to calculate a change in intake pressure (Δp) in step S16. The change in intake pressure (Δp) is calculated from Equation 6 below, in which the absolute value of the difference between a present intake pressure (p_t2) and a previous intake pressure (p_t1) is obtained.

$$\Delta p = p_t2 - p_t1 \quad \text{[Equation 6]}$$

Subsequently, it is determined if the change in intake pressure (Δp) is greater than a first critical value (threshold1) in step S17. If this condition is satisfied, it is determined that a change has occurred to a part load or a full load state from an idle or a light load state. Also, if the change in intake pressure (Δp) is greater than the first critical value (threshold1) in step S17, a first final fuel amount compensation value (% fuel_final1) is calculated and then used to control a final fuel amount (% fuel_final) in step S18.

The first final fuel amount compensation value (% fuel_final1) is obtained from Equation 7 below. As shown in the equation, a product of a compensation constant K1, the change in intake pressure (Δp), and the purge fuel amount compensation value (% fuel_purge) is subtracted from the integer 1, after which the result is multiplied to a base fuel amount. Here, the compensation constant K1 is less than 1.

$$\%\ \text{fuel_final} = \text{base fuel amount} \times (1 - K1 \times \Delta p \times \%\ \text{fuel_purge}) \quad \text{[Equation 7]}$$

Therefore, if the final fuel amount (% fuel_final) is compensated by applying the first final fuel amount compensation value (% fuel_final1) according to the change in intake pressure (Δp), the compensation fuel amount is offset at a constant rate.

In step S15, if it is determined that the purge fuel amount compensation value (% fuel_purge) is not greater than the first critical rate (th_p1), it is determined if the purge fuel amount compensation value (% fuel_purge) is less than a second critical rate (th_p2) in step S19. The second critical rate (th_p2) may be set at 20%. At this time, a purge fuel amount compensation value (% fuel_purge) less than the second critical rate (th_p2) is indicative of a low concentration of hydrocarbons in the canister.

If it is determined that the purge fuel amount compensation value (% fuel_purge) is less than the second critical rate (th_p2) in step S9, the intake pressure is measured using the MAP sensor 13 to calculate the change in intake pressure (Δp) in step S20. The change in intake pressure (Δp) is calculated identically as in the above, that is, using Equation 6, in which the absolute value of the difference between a present intake pressure (p_t2) and a previous intake pressure (p_t1) is obtained.

Subsequently, it is determined if the change in intake pressure (Δp) is less than a second critical value (threshold2) in step S21. If this condition is satisfied, it is determined that a change has occurred to an idle or a light load state from a part load or a full load state. Also, if the change in intake pressure (Δp) is less than the second critical value (threshold2) in step S21, a second final fuel amount compensation value (% fuel_final2) is calculated and then used to control the final fuel amount (% fuel_final) in step S22.

The second final fuel amount compensation value (% fuel_final2) is obtained using Equation 7 identically to the first final fuel amount compensation value (% fuel_final1). That is, a product of a compensation constant K1, the change in intake pressure (Δp), and the purge fuel amount compensation value (% fuel_purge) is subtracted from the integer 1, after which the result is multiplied to a base fuel amount. Here, the compensation constant K1 is greater than 1.

Therefore, if the final fuel amount (% fuel_final) is compensated by applying the second final fuel amount compensation value (% fuel_final2) according to the change in intake pressure (Δp), the compensation fuel amount is offset at a constant rate.

In the above described system and method for controlling fuel injection of the present invention, if the concentration of hydrocarbons in purge gas contained in the canister is high, the compensation of the purge fuel amount increases, and in the case where acceleration is performed from a light load to a part load or to a full load, the intake pressure immediately increases. Accordingly, during control of the supply of purge gas through the PCSV, the problem of hesitation or jerky forward motion is prevented with the application of the control method of the present invention.

Further, in the case where air is mostly present in the canister, the purge air amount compensation value increases, and if deceleration is performed from a part load or a full load to a light load, the intake pressure immediately decreases. Accordingly, during control of the supply of purge gas, the problem of excessive fuel consumption is prevented with the application of the control method of the present invention.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method for controlling fuel injection, in which an ECU for controlling an engine calculates a base fuel amount, receives an output voltage from an oxygen sensor, and calculates a purge fuel amount compensation value and a final fuel amount using a feedback gain, a purge ratio, and a purge concentration, which are based on a difference between the output voltage and a standard voltage, after which the ECU controls a fuel amount that is supplied through a fuel injector, the method comprising:

detecting a purge duty signal and determining if conditions for a purge interval of the engine are satisfied;

determining if conditions for feedback control of the engine are satisfied;

receiving intake pressure signals from a MAP sensor;

calculating the purge ratio and the purge concentration;

calculating the purge fuel amount compensation value using the purge ratio and the purge concentration;

determining if the purge fuel amount compensation value is greater than a first critical rate;

calculating a change in intake pressure if the purge fuel amount compensation value is greater than the first critical rate;

determining if the change in intake pressure is greater than a first critical value;

calculating a first final fuel amount compensation value if the change in intake pressure is greater than the first critical value, and controlling the final fuel amount using the first final fuel amount compensation value;

determining if the purge fuel amount compensation value is less than a second critical rate if the purge fuel amount compensation value is not greater than the first critical rate;

calculating the change in intake pressure if the purge fuel amount compensation value is less than the second critical rate;

determining if the change in intake pressure is less than a second critical value; and calculating a second final fuel amount compensation value if the change in intake pressure is less than the second critical value, and controlling the final fuel amount using the second final fuel amount compensation value.

2. The method of claim 1 wherein the change in intake pressure is obtained by taking the absolute value of a difference between a present intake pressure and a previous intake pressure.

3. The method of claim 1 wherein the first final fuel amount compensation value is obtained by subtracting a product of a compensation constant, the change in intake pressure, and the purge fuel amount compensation value from the integer 1, then multiplying the result by the base fuel amount.

4. The method of claim 3 wherein the compensation constant is less than 1.

5. The method of claim 1 wherein the second final fuel amount compensation value is obtained by subtracting a product of a compensation constant, the change in intake pressure, and the purge fuel amount compensation value from the integer 1, then multiplying the result by the base fuel amount.

6. The method of claim 5 wherein the compensation constant is greater than 1.

7. The method of claim 1, further comprising:

determining if the purge fuel amount compensation value is less than a second critical rate if the purge fuel amount compensation value is not greater than the first critical rate;

calculating the change in intake pressure if the purge fuel amount compensation value is less than the second critical rate;

determining if the change in intake pressure is less than a second critical value; and calculating a second final fuel amount compensation value if the change in intake pressure is less than the second critical value, and controlling the final fuel amount using the second final fuel amount compensation value.

8. A system for controlling fuel injection comprising an ECU for controlling an engine including a fuel injector according to signals received from a purge control solenoid valve, an engine rpm sensor, a throttle valve position sensor, an oxygen sensor, and a MAP sensor for indirectly detecting an intake pressure from vacuum variations of an intake manifold and output voltage signals, wherein the ECU, in a purge interval, calculates a base fuel amount and a purge fuel amount compensation value, and when changing from one of an idle state and a light load state to one of a part load and a full load state, applies a first final fuel amount compensation value to compensate a final fuel amount in the case where the purge fuel amount compensation value is excessively positively learned, the first final fuel amount compensation value being obtained by subtracting a product of a first compensation constant, a change in intake pressure, and the purge fuel amount compensation value from the integer 1, then multiplying the result by the base fuel amount, and wherein the ECU, when changing from one of the part load state and the full load state to one of the idle state and the light load state, applies a second final fuel amount compensation value to compensate the final fuel amount in the case where the purge fuel amount compensation value is excessively negatively learned, the first final fuel amount compensation value being obtained by subtracting a product of a second compensation constant, a change in intake pressure, and the purge fuel amount compensation value from the integer 1, then multiplying the result by the base fuel amount.

9. A method for controlling fuel injection in an internal combustion engine, comprising:

sensing manifold absolute pressure;

calculating a purge ratio and a purge concentration;

calculating a purge fuel amount compensation value using the purge ratio and the purge concentration;

determining if the purge fuel amount compensation value is greater than a first critical rate;

calculating a change in intake pressure based on sensed manifold absolute pressure if the purge fuel amount compensation value is greater than the first critical rate;

determining if the change in intake pressure is greater than a first critical value;

calculating a first final fuel amount compensation value if the change in intake pressure is greater than the first critical value; and controlling a final fuel amount using the first final fuel amount compensation value.

10. The method according to claim 9, further comprising initially detecting a purge duty signal and determining if conditions for a purge interval of the engine are satisfied, and determining if conditions for feedback control of the engine are satisfied.

11. The method of claim 9, wherein said steps are executed by an electronic control unit that receives an output voltage from an oxygen sensor, and calculates the purge fuel amount compensation value and final fuel amount using a feedback gain, a purge ratio, and a purge concentration, which are based on a difference between the output voltage and a standard voltage.

12. A system for controlling fuel injection in an internal combustion engine, comprising an electronic control unit (ECU) receiving signals from a purge control solenoid valve, an engine rpm sensor, a throttle valve position sensor, an oxygen sensor, and a manifold absolute pressure (MAP) sensor for indirectly detecting an intake pressure from vacuum variations of an intake manifold and output voltage signals, wherein:

the ECU is programmed to execute instructions for controlling an amount of fuel to a fuel injector based on parameters comprising at least a change in intake pressure as calculated by the ECU based on signals received from the MAP sensor and a feedback gain, a purge ration and a purge concentration as determined by the ECU based on comparison of the sensor output signals with predetermined standard signals;

the ECU is programmed such that, when changing from either an idle state or a light load state to either a part load or a full load state, a first final fuel amount compensation value is applied to compensate the final fuel amount in the case where the purge fuel amount compensation value is excessively positively learned, said first final fuel amount compensation value being obtained by subtracting a product of a first compensation constant, said change in intake pressure, and said purge fuel amount compensation value from the integer 1, then multiplying the result by the base fuel amount.

13. The system of claim 12, wherein:

the ECU is programmed to calculate a base fuel amount and a purge fuel amount compensation value by which the base fuel amount is multiplied to determine a final fuel amount; and said purge fuel amount compensation value is based at least in part on said change in intake pressure.

14. The system of claim 12, wherein the ECU is programmed such that, when changing from either the part load state or the full load state to either the idle state or the light load state, a second final fuel amount compensation value is applied to compensate the final fuel amount in the case where the purge fuel amount compensation value is excessively negatively learned, the first final fuel amount compensation value being obtained by subtracting a product of a second compensation constant, said change in intake pressure, and said purge fuel amount compensation value from the integer 1, then multiplying the result by the base fuel amount.

* * * * *